US006623915B1

(12) United States Patent
Haye et al.

(10) Patent No.: US 6,623,915 B1
(45) Date of Patent: Sep. 23, 2003

(54) STABLE PHOTOGRAPHIC COLOR DEVELOPING COMPOSITION AND METHOD OF USE

(75) Inventors: Shirleyanne E. Haye, Rochester, NY (US); Janet M. Huston, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/216,994

(22) Filed: Aug. 12, 2002

(51) Int. Cl.[7] ..... G03C 7/413
(52) U.S. Cl. ..... 430/490
(58) Field of Search ..... 430/490

(56) References Cited

U.S. PATENT DOCUMENTS 6,213,657 B1 * 4/2001 Kobayashi ..... 396/604

* cited by examiner

*Primary Examiner*—Hoa Van Le

(74) *Attorney, Agent, or Firm*—J. Lanny Tucker

(57) ABSTRACT

Concentrated and working strength photographic color developing compositions are stabilized with the inclusion of a sulfur compound as a preservative for a color developing agent. The preservative can be represented by one of the following Structures I, II, III, and IV:

$$M_1S—R—CH(NH_2)—COOM_2 \quad (I)$$

$$M_1S—R_1—COOM_2 \quad (II)$$

$$R_2—S—S—R_2 \quad (III)$$

$$R_3HN—R_4—SM_1 \quad (IV)$$

wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a —$CH(NHR_3)$—$COOM_2$ or —($C_1$–$C_3$) alkylene-$CH(NHR_3)$—$COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group. These compositions can be used to process color photographic materials.

21 Claims, No Drawings

STABLE PHOTOGRAPHIC COLOR DEVELOPING COMPOSITION AND METHOD OF USE

FIELD OF THE INVENTION

The present invention relates to concentrated and working strength photographic color developing compositions that have improved stability, and to methods for their use. This invention is useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have found considerable commercial success in the photographic industry. Other known color developing compositions are described in U.S. Pat. No. 4,876,174 (Ishikawa.et al.), U.S. Pat. No. 5,354,646 (Kobayashi et al.), and U.S. Pat. No. 5,660,974 (Marrese et al.).

It is generally known that the concentrations of various photochemicals used in a photographic color developing composition must be within certain narrow limits in order to provide optimal performance. This is particularly true of "concentrates" or single-part compositions.

There is a trend in the photographic industry to provide photoprocessing compositions (including color developing compositions) in concentrated form so that the manufacturer and user need not pay for use, transport or storage of large volumes of water, and to enable use of smaller containers. Moreover, there has been a desire in the industry to provide compositions that can be used right out of their containers without the need for mixing various components (thereby reducing mixing errors), such as in what are known as "automatic replenishing" processors.

One concentrated form known in the art is a chemical paste or slurry, as described for example in EP-A-0 204,372 (Chemco) and EP-A-0 800,111 (Fuji Photo). These formulations have still other disadvantages, namely lack of homogeneity and slow dissolution rate of solid components.

Additional small volume, ready to use color developing compositions are described in U.S. Pat. No. 5,273,865 (Loiacono et al.). These compositions are said to be free of bromides, hydroxylamines and benzyl alcohol, to include a polyol compound having 4 to 8 hydroxy groups, and to be useful for rapid access processing of photographic elements having high silver bromide emulsions only.

A very useful single-part color developing composition that is homogeneous, concentrated, and stable is described and claimed in U.S. Pat. No. 6,077,651 (Darmon et al.). Such compositions are stable from the presence of the free base form of the color developing agent and a particular amount of water-soluble organic solvent.

Stability of the color developing agents in such compositions is generally achieved using sulfite ions or any of the many conventional organic antioxidants (or preservatives) that reduce aerial oxidation rates. For example, U.S. Pat. No. 4,892,804, U.S. Pat. No. 4,876,174, U.S. Pat. No. 5,354,646, and U.S. Pat. No. 5,660,974 (all noted above) describe hundreds of possible derivatives of hydroxylamines that can be used as antioxidants in color developing compositions.

However, there is a desire in the photoprocessing industry to find additional means of stabilizing color developing compositions, especially concentrated compositions. There is also a desire to reduce the amounts of organic antioxidants including hydroxylamine derivatives for a number of reasons without losing the ability to reduce aerial oxidation.

SUMMARY OF THE INVENTION

This invention provides an aqueous photographic color developing composition having a pH of from about 7 to about 13 and comprising:

a) at least 0.0005 mol/l of a color developing agent, and b) as a preservative for the color developing agent, from about 0.0005 to about 0.5 mol/l of a sulfur compound that is represented by one of the following Structures I, II, III, and IV:

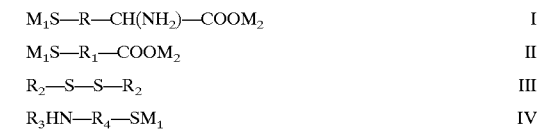

$M_1S—R—CH(NH_2)—COOM_2$ I $M_1S—R_1—COOM_2$ II $R_2—S—S—R_2$ III $R_3HN—R_4—SM_1$ IV wherein R is a divalent aliphatic linking group having at least 1 carbon atom in the chain, $R_1$ is phenylene or an unsubstituted-alkylene having 1 or 2 carbon atoms, $R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group.

In preferred embodiments, this invention provides a concentrated, aqueous, single-part color developing composition having a pH of from about 8 to about 12 and comprising:

a) from about 0.005 to about 1 mol/l of a color developing agent in free base form, b) less than 0.00005 mol/l of hydroxylamine or a derivative thereof, c) a water-miscible or water-soluble hydroxy-substituted, straight-chain organic solvent that has a molecular weight of from about 50 to about 200, d) a buffering agent that is solvent in the organic solvent, e) from about 0.005 to about 0.3 mol/l of a calcium ion sequestering agent, and f) as a preservative for the color developing agent, from about 0.005 to about 5 mol/l of one or more isomers of cysteine or a hydrochloride salt thereof, homocysteine, methionine, 3-mercaptovaline, 2-mercaptopropionic acid, 3-mercaptopropionic acid, 3-mercapto-1-benzoic acid, mercaptoacetic acid, one or more isomers of cystine or hydrochloride salts thereof, mesocystine, 3,3'-dithiobisvaline or a hydrochloride salt thereof, 2-aminoethanethiol, 2-aminoethanethiol hydrochloride, 3-aminopropanethiol hydrochloride, or any appropriate carboxylate salt thereof.

This invention also addresses the problems noted above with a two-part color developing kit comprising:

(I) a first aqueous solution having a pH of from about 9 to about 14, and (II) a second aqueous solution having a pH of from about 3 to about 7 and comprising:

(a) at least 0.005 mol/l of a color developing agent, (b) at least 0.001 mol/l of sulfite ions, further comprising, in the first or second aqueous solution, from about 0.005 to about 5 mol/1 of a sulfur compound represented by one of the following Structures I, II, III, and IV:

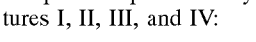

$M_1S—R—CH(NH_2)—COOM_2$ I

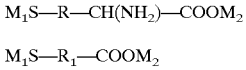

$M_1S—R_1—COOM_2$ II

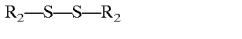

$R_2—S—S—R_2$ III

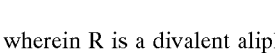

$R_3HN—R_4—SM_1$ IV wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group.

Still again, this invention also provides a method of making a working strength color developing composition from the two aqueous solutions noted above comprising:

A) combining the first and second aqueous solutions noted above in such a manner that the volume ratio of the first aqueous solution to the second aqueous solution is from about 2:1 to about 1:2 and, B) simultaneously or subsequently, diluting the first and second aqueous solutions with water in such a manner as to dilute the first aqueous solution at least two times and the second aqueous solution at least two times.

Further, this invention provides an advance in the art with a three-part color developing kit comprising:

(I) a first aqueous solution having a pH of from about 9 to about 13, (II) a second aqueous solution having a pH of from about 1 to about 4 and comprising:

(a) at least 0.005 mol/l of a color developing agent, and (b) at least 0.001 mol/l of sulfite ions, and (III) a third aqueous solution having a pH of from about 10 to about 13.5, wherein the first, second, or third aqueous solutions further comprise from about 0.005 to about 5 mol/l of a sulfur compound represented by one of the following Structures I, II, III, and IV:

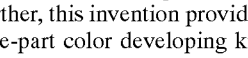

$M_1S—R—CH(NH_2)—COOM_2$ I

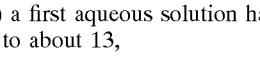

$M_1S—R_1—COOM_2$ II

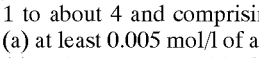

$R_2—S—S—R_2$ III

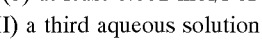

$R_3HN—R_4—SM_1$ IV wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group.

This invention also provides a method of making a working strength color developing composition from the three-part color developing kit noted above comprising:

A) combining the first, second, and third aqueous solutions noted above in such a manner that the volume ratio of the first aqueous solution to the second aqueous solution is from about 1:1 to about 1.5: 1, the volume ratio of the first aqueous solution to the third aqueous solution is from about 1:1 to about 1.5: 1, and the volume ratio of the second aqueous solution to the third aqueous solution is from about 1:1 to about 1.5:1, and, B) simultaneously or subsequently, diluting the first, second, and third aqueous solutions with water in such a manner as to dilute the first aqueous solution at least 8 times, the second aqueous solution at least 10 times, and the third aqueous solution at least 10 times.

Further, this invention provides a method for providing a color image in a color photographic silver halide element comprising contacting- the element with an aqueous photographic color developing composition having a pH of from about 7 to about 13 and comprising:

a) at least 0.005 mol/l of a color developing agent, and b) as preservative for the color developing agent, from about 0.005 to about 5 mol/l of a sulfur compound that is represented by one of the following Structures I, II, III, and IV:

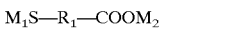

$M_1S—R—CH(NH_2)—COOM_2$ (I)

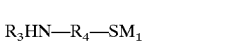

$M_1S—R_1—COOM_2$ (II)

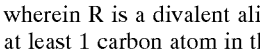

$R_2—S—S—R_2$ (III)

$R_3HN—R_4—SM_1$ (IV)

wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group.

A method for providing a color image in a color photographic silver halide element comprises contacting the element with an aqueous working strength color developing composition prepared by diluting the aqueous color developing composition described above at least two times.

In addition, a method of photographic processing comprises the steps of:

A) color developing an imagewise exposed color photographic silver halide element with a photographic color developing composition comprising a color developing agent and a sulfur compound as a preservative for the color developing agent, the preservative being represented by one of the following Structures I, II, III, and IV:

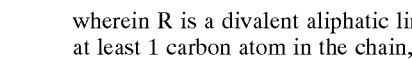

$$M_1S—R—CH(NH_2)—COOM_2 \quad (I)$$

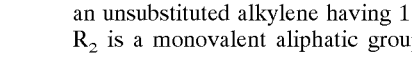

$$M_1S—R_1—COOM_2 \quad (II)$$

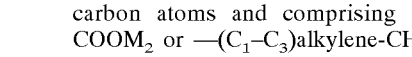

$$R_2—S—S—R_2 \quad (III)$$

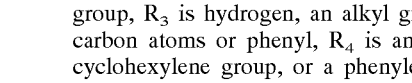

$$R_3HN—R_4—SM_1 \quad (IV)$$

wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group, and B) desilvering the color developed color photographic silver halide element.

The color developing composition of this invention offers a number of advantages over the color developing compositions currently available or known in the art. The concentrated and working strength compositions of this invention are stabilized with the presence of a sulfur compound preservative that is defined by Structure I, II, III, or IV described herein, and that acts as a preservative for the color developing agent. This means that the chemical loss (breakdown) of color developing agent is reduced. Moreover, the amount of conventional organic antioxidants, such- as hydroxylamine derivatives, can be reduced or eliminated in some embodiments without sacrificing composition stability. This may allow for reduced odors or component costs. In other embodiments, synergistic effect is observed with a combination of a sulfur compound preservative and a conventional hydroxylamine antioxidant.

DETAILED DESCRIPTION OF THE INVENTION

In one embodiment, the color developing composition of this invention can be formulated as an aqueous concentrate, such as a single-part concentrate, that can then be diluted at least two times with water or buffer (preferably at least four times) to form a working strength color developing composition. Alternatively, the working strength composition of this invention can be prepared by mixing all of the desired components in any desired order at working strength concentrations. Still again, the invention can be provided as a two- or three-part color developing kit that includes the essential and optional components in the various "parts" or solutions (either concentrated or diluted).

The compositions of this invention contain one or more color developing agents that may be in the form of a sulfate salt or in free base form as a first essential component. Other components of the composition include one or more sulfur compounds as preservatives, as described below, and one or more optional addenda described below.

More specifically, the color developing compositions of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (September 1996).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In preferred embodiments of concentrated compositions that may be useful for processing photographic color papers, the color developing agents (such as KODAK Color Developing Agent CD-3) are used in "free base form" as described in U.S. Pat. No. 6,077,651 (noted above).

The developing composition includes one or more sulfur-containing compounds as the stabilizing agents or preservatives for the color developing agent. These compounds can be represented by any of Structure 1, II, III, or IV below.

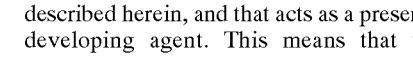

$$M_1S—R—CH(NH_2)—COOM_2 \quad (I)$$

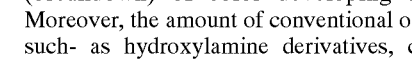

$$M_1S—R_1—COOM_2 \quad (II)$$

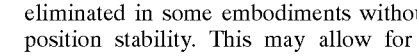

$$R_2—S—S—R_2 \quad (III)$$

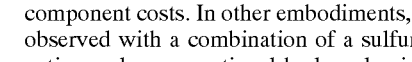

$$R_3HN—R_4—SM_1 \quad (IV)$$

wherein R is a divalent aliphatic linking group having at least 1 carbon atom in the chain. Representative divalent aliphatic linking groups include but are not limited to, substituted or unsubstituted alkylene groups (linear or branched) having 2 to 10 carbon atoms, a substituted or unsubstituted phenylene group, or a substituted or unsubstituted cyclohexylene group. Preferably, R is substituted or unsubstituted alkylene having 1 to 4 carbon atoms, and more preferably R is methylene or ethylene.

$R_1$ is substituted or unsubstituted phenylene, or an unsubstituted alkylene group having 1 or 2 carbon atoms. Where $R_1$ is phenylene, the mercapto and carboxy groups are preferably in the 1,3- or 1,4-positions. More preferably $R_1$ is an unsubstituted alkylene having 2 carbon atoms.

$R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group wherein the $C_1–C_3$ alkylene moiety can comprise substituted or unsubstituted linear or branched alkylene groups. Representative $R_2$ monovalent aliphatic groups include the same type of groups defined for R above. Preferably, $R_2$ is substituted or unsubstituted alkyl having 1 to 4 carbon atoms, and more preferably $R_2$ is methyl or ethyl.

$R_3$ is hydrogen, a substituted or unsubstituted alkyl group having 1 to 4 carbon atoms or phenyl, and preferably $R_3$ is methyl or ethyl.

$R_4$ is a substituted or unsubstituted alkylene group (linear or branched) having 1 to 4 carbon atoms, a substituted or unsubstituted cyclohexylene group, or a substituted or unsubstituted phenylene group. Preferably, $R_4$ is a substituted or unsubstituted alkylene group having 1 to 3 carbon atoms, and more preferably it is ethylene.

$M_1$ and $M_2$ are independently hydrogen, an alkali metal or ammonium ion, or methyl group and preferably $M_1$ is hydrogen and $M_2$ is either hydrogen or an alkali metal ion.

The monovalent and divalent aliphatic groups in the Structures noted above can include carbon atom chains that are interrupted with one or more divalent groups containing nitrogen, sulfur or oxygen atoms.

Representative preservatives of Structure I include cysteine (D or L) and the hydrochloride salt thereof, homocysteine, methionine, 3-mercaptovaline and carboxylate salts thereof. L-cysteine and L-cysteine hydrochloride are preferred in this group of compounds. Mixtures of stereoisomers (where possible) can also be used.

Representative preservatives of Structure II include 2-mercaptopropanoic acid, 3-mercaptopropanoic acid, 3-mercapto-1-benzoic acid, mercaptoacetic acid, and carboxylate salts thereof.

Representative preservatives of Structure III include cystine (D or L), mesocystine, 3,3'-dithiobisvaline or hydrochloride salt thereof, and carboxylate salts thereof. Mixtures of stereoisomers can be used where possible.

Representative preservatives of Structure IV include 2-aminoethanethiol, 2-aminoethanethiol hydrochloride and 3-aminopropanethiol hydrochloride.

Thus, the preferred group of preservatives useful in this invention includes one or more isomers of cysteine or a hydrochloride salt thereof, homocysteine, methionine, 3-mercaptovaline, 2-mercaptopropionic acid, 3-mercaptopropionic acid, 3-mercapto-1-benzoic acid, mercaptoacetatic acid, one or more isomers of cystine or hydrochloride salts thereof, mesocystine, 3,3'dithiobisvaline or a hydrochloride salt thereof, 2-aminoethanethiol, 2-aminoethanethiol hydrochloride, 3-aminopropanethiol hydrochloride, or any appropriate carboxylate salts thereof.

Of these, one or more isomers of cysteine or cystine or a salt thereof are most preferred.

Mixtures of these preservativess of any of Structures I to IV can be used if desired. In the multi-part color developing kits of this invention, the preservatives can be incorporated in any or all of the various "parts" or solutions. Preferably, they are incorporated in the "parts" that include the color developing agent(s).

The color developing compositions can also include sulfite ions provided from sodium sulfite, potassium sulfite, sodium bisulfite, and potassium metabisulfite.

The noted sulfur compound preservatives can be used to reduce or eliminate the presence of conventional organic preservatives or antioxidants (such as hydroxylamine and derivatives thereof). Thus, the compositions are substantially free of such conventional antioxidants, meaning that less than 0.00005 mol/l of such compounds are present. However, it is not required that such conventional antioxidants be completely absent. Such conventional organic antioxidants generally include hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes.

Buffering agents are generally present in the color developing compositions of this invention to provide or maintain desired alkaline pH of from about 7 to about 13, preferably from about 8 to about 12, and more preferably from about 9 to about 11. These buffering agents are preferably soluble in the organic solvent described herein and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred buffering agents. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

An optional but preferred component of the color developing compositions of this invention (especially "single-part" compositions containing KODAK Color Developing Agent CD-3) is a photographically inactive, water-miscible or water-soluble, straight-chain organic solvent that is capable of dissolving color developing agents in their free base forms. Such organic solvents can be used singly or in combination, and preferably each has a molecular weight of at least 50, and preferably at least 100, and generally 200 or less and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

By "photographically inactive" is meant that the organic solvents provide no substantial positive or negative effect upon the color developing function of the concentrate.

Useful organic solvents include, but are not limited to, polyols including glycols (such as ethylene glycol, diethylene glycol and triethylene glycol), polyhydroxyamines (including polyalcoholamines), and alcohols (such as ethanol and benzyl alcohol). Glycols are preferred with ethylene glycol, diethylene glycol and triethylene glycol being most preferred. Of the alcohols, ethanol and benzyl alcohol are most preferred. The most preferred organic solvent is diethylene glycol.

Another optional but preferred component of the color developing composition of this invention is a calcium ion sequestering agent such as a polycarboxylic acid or a polyaminopolyphosphonic acid (or salts thereof). Mixtures of these compounds can also be used. There are many such compounds known in the art including U.S. Pat. No. 4,546,068 (Kuse), U.S. Pat. No. 4,596,765 (Kurematsu et al.), U.S. Pat. No. 4,892,804 (noted above), U.S. Pat. No. 4,975,357 (Buongiome et al.), U.S. Pat. No. 5,034,308 (Abe et al.), and *Research Disclosure* publications Item 20405 (April, 1981), Item 18837 (December, 1979), Item 18826 (December, 1979), and Item 13410 (December, 1975).

Phosphonic acid metal ion sequestering agents are well known in the art, and are described for example in U.S. Pat. No. 4,596,765 (noted above) and *Research Disclosure* publications Item 13410 (June, 1975), 18837 (December, 1979), and 20405 (April, 1981).

Useful sequestering agents are readily available from a number of commercial sources. Particularly useful phosphonic acids are the diphosphonic acids (and salts thereof) and polyaminopolyphosphonic acids (and salts thereof) described below. It is preferable to use one or more compounds of these classes in combination. Useful diphosphonic acids include hydroxyalkylidene diphosphonic acids, aminodiphosphonic acids, amino-N,N-dimethylenephosphonic acids, and N-acyl aminodiphosphonic acids.

Particularly useful polyphosphonic acids (and salts thereof) are compound that have at least five phosphonic acid (or salt) groups (herein "First Calcium Ion Sequestering Agent"). A mixture of-such compounds can be used if desired. Suitable salts include ammonium and alkali metal ions salts.

Preferred compounds of this nature- can be represented by the following Structure V:

(V)

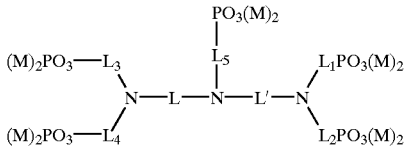

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain. Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

The noted divalent groups can be substituted with any substituent that does not interfere with the desired performance of the sequestering agent, or with the photochemical properties of the color developing compositions. Such substituents include, but are not limited to, hydroxy, sulfo, carboxy, halo, lower alkoxy (1 to 3 carbon atoms) or amino.

A particularly useful First Calcium Ion Sequestering Agent is diethylenetriaminepentamethylenephosphosphonic acid or an alkali metal salt thereof (available as DEQUEST™ 2066 from Solutia Co.).

Still another optional but preferred calcium ion sequestering agent is a diphosphonic acid (or salt thereof), herein referred to as "Second Calcium Ion Sequestering Agent".

One useful class of Second Calcium Ion Sequestering Agents includes hydroxyalkylidene diphosphonic acids (or salts thereof). Mixtures of such compounds can be used if desired. Useful salts include the ammonium and alkali metal ion salts.

Preferred hydroxyalkylidene diphosphonic acids (or salts thereof) can be represented by the following Structure VI:

(VI)

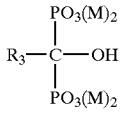

wherein $R_5$ is a substituted or unsubstituted alkyl group having 1 to 5 carbon atoms (methyl, methoxymethyl, ethyl, isopropyl, n-butyl, t-butyl and n-pentyl)and M is hydrogen or a monovalent cation (such as ammonium or alkali metal ions). Preferably, $R_5$ is methyl or ethyl, and most preferably, it is ethyl.

Representative Second Calcium Ion Sequestering Agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily apparent to one skilled in the art (and alkali metal and ammonium salts thereof). The first compound is most preferred and is available as DEQUEST,™ 2010, and its tetrasodium salt is available as DEQUEST™ 2016D, both from Solutia Co.

Another useful Second Calcium Ion Sequestering Agent is morpholinomethanediphosphonic acid or a salt thereof that is available as BUDEX™ 5103 from Budenheim (Germany). This and similar cyclicaminodiphosphonic acids (and salts thereof) are described in U.S. Pat. No. 4,873,180 (Marchesano et al.).

It is also possible to include other metal ion sequestering agents (for example, for iron, copper, and/or manganese ion sequestration) in the color developing composition as long as the other conditions of the invention are met.

The color developing compositions of this invention can also include one or more of a variety of other addenda that are commonly used in photographic color developing compositions, including alkali metal halides (such as potassium chloride, potassium bromide, sodium bromide and sodium iodide), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure* publications noted above]. The amounts of such additives are well known in the art also. Representative color developing compositions of this invention are described below in the examples.

It is preferred that no lithium or magnesium ions are purposely added to the color developing compositions of this invention. Depending upon the concentrations of such ions in water used to make up processing solutions, or carried over from previous processing baths, the total concentration (that is, the sum) of these ions remains preferably very low, that is less than 0.0001 mol/l in the compositions, and preferably a total of less than 0.00001 mol/l.

The following TABLES I and II list the general and preferred amounts of the essential and some optional components of the color developing compositions (concentrates and working strength compositions, respectively) of this invention. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE I (CONCENTRATES)

| COMPONENT | CONCENTRATIONS |
|---|---|
| Color developing agent(s) | 0.005–1 mol/l (0.05–0.8 mol/l) |
| Sulfur compound preservative(s) | 0.005–5 mol/l (0.05–3 mol/l) |
| Organic solvent(s) to water (if organic solvent used) | 0.15:1 to 1.5:1 (0.67:1 to 1.2:1) |

TABLE I-continued (CONCENTRATES)

| COMPONENT | CONCENTRATIONS |
|---|---|
| Buffering agent(s) | 0.5–3 mol/l (1.5–2.5 mol/l) |
| First Calcium Ion Sequestering Agent(s) | 0.005–0.3 mol/l (0.01–0.1 mol/l) |
| Second Calcium Ion Sequestering Agent(s) | 0–0.3 mol/l (0–0.05 mol/l) |

TABLE II (WORKING STRENGTH)

| COMPONENT | CONCENTRATIONS |
|---|---|
| Color developing agent(s) | 0.0005–0.25 mol/l (0.005–0.03 mol/l) |
| Sulfur compound preservative(s) | 0.0005–0.5 mol/l (0.005–0.3 mol/l) |
| α-Ketocarboxylic acid(s) (or salts) | 0.005–0.25 mol/l (0.01–0.2 mol/l) |
| Buffering agent(s) | 0.002–0.8 mol/l (0.01–0.5 mol/l) |

While the foregoing TABLES I and II show concentrations for First and Second Calcium Ion Sequestering Agents that are polyphosphonic acids it would be appreciated by one skilled in the art that other calcium ion sequestering agents (such as polycarboxylic acids) would be useful in similar or conventional amounts.

The following TABLES III, IV, and V show general and preferred concentrations for three-part color developing compositions of this invention. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE III

FIRST SOLUTION

| COMPONENT | CONCENTRATIONS |
|---|---|
| Organic antioxidant(s) | 0–2 mol/l (0.05–1.5 mol/l) |
| Sulfur compound preservative(s) | 0–5 mol/l (0.05–3 mol/l) |
| pH | 9–13 (9–11) |

TABLE IV

SECOND SOLUTION

| COMPONENT | CONCENTRATIONS |
|---|---|
| Color developing agent(s) | 0.005–1 mol/l (0.05–0.8 mol/l) |
| Sulfite ions | 0.001–0.5 mol/l (0.01–0.3 mol/l) |

TABLE IV-continued

SECOND SOLUTION

| COMPONENT | CONCENTRATIONS |
|---|---|
| Sulfur compound preservative(s) | 0–5 mol/l (0.05–3 mol/l) |
| pH | 1–4 (1–3.75) |

TABLE V

THIRD SOLUTION

| COMPONENT | CONCENTRATIONS |
|---|---|
| Sulfur compound preservative(s) | 0–5 mol/l (0.05–3 mol/l) |
| pH | 7–14 (10–14) |

The following TABLES VI and VII list the general and preferred amounts of the essential and some optional components of the first and second aqueous solutions used in the two-part color developing kits of this invention. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE VI

FIRST SOLUTION

| COMPONENT | CONCENTRATIONS |
|---|---|
| Buffer(s) if present | 0.5–7.5 mol/l (1.5–6 mol/l) |
| Sulfur compound preservative(s) | 0–5 mol/l (0.05–3 mol/l) |
| pH | 9–14 (11–14) |

TABLE VII

SECOND SOLUTION

| COMPONENT | CONCENTRATIONS |
|---|---|
| Color developing agent(s) | 0.005–1 mol/l (0.05–0.8 mol/l) |
| Sulfite ions | 0.001–0.5 mol/l (0.01–0.3 mol/l) |
| Organic antioxidant(s) | 0–2.5 mol/l (0–2 mol/l) |
| Sulfur compound preservative(s) | 0–5 mol/l (0.05–3 mol/l) |
| pH | 3–7 (4–6) |

The color developing compositions of this invention have utility to provide color development in an imagewise exposed color photographic silver halide element comprising a support and one or more silver halide emulsion layers containing an imagewise distribution of developable silver halide emulsion grains. A wide variety of types of photographic elements (both color negative and color reversal films and papers, and color motion picture films and prints) containing various types of emulsions can be processed using the present invention, the types of elements being well known in the art (see *Research Disclosure* publication 38957 noted above). In particular, the invention can be used to process color photographic papers of all types of emulsions including so-called "high chloride" and "low chloride" type emulsions, and so-called tabular grain emulsions as well. The color developing composition can also be used in processing of color reversal and color negative films.

Some embodiments of the are particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g silver/$m^2$) elements are processed with the present invention. The layers of the photographic elements can have any useful binder material or vehicle as it known in the art, including various gelatins and other colloidal materials.

Representative commercial color papers that are useful in the practice of this invention include, but are not limited to, KODAK EKTACOLOR EDGE 5, 7, 8, and 9 Color Papers (Eastman Kodak Company), KODAK EKTACOLOR ROYAL VII and VIII Color Papers (Eastman Kodak Company), KODAK PROFESSIONAL PORTRA IV Color Papers (Eastman Kodak Company), KODAK PROFESSIONAL SUPRA III and IV Color Papers (Eastman Kodak Company), KODAK PROFESSIONAL ULTRA III Color Papers (Eastman Kodak Company), KODAK PROFESSIONAL METALLIC Color Papers (Eastman Kodak Company), KODAK DURALIFE Color Paper (Eastman Kodak Company), KODAK PROFESSIONAL PORTRA Black and White Papers (Eastman Kodak Company), FUJI SUPER Color Papers (Fuji Photo Co., FA5, FA7 and FA9), FUJI CRYSTAL ARCHIVE and Type C and D Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art.

KODAK PROFESSIONAL DURATRANS display materials, KODAK DURACLEAR, KODAK EKTAMAX RAL and KODAK PROFESSIONAL DURAFLEX print materials, and KODAK PROFESSIONAL Digital III Color Paper Type can also be processed using the present invention. The compositions and constructions of such commercial color photographic elements could be readily determined by one skilled in the art.

Representative color negative materials that can be processed to advantage using the present invention include, but are not limited to, KODAK ROYAL GOLD Color Films (especially the 1000 speed color film), KODAK GOLD MAX Color Films, KODAK ADVANTIX Color Films, KODAK VERICOLOR III Color Films, KONICA VX400 Color Film, KONICA Super SR400 Color Film, KONICA CENTURIA Color Negative Films, FUJI SUPERIA and NEXIA Color Films, and LUCKY Color Films. Other elements that could be used in the practice of this invention would be readily apparent to one skilled in the art.

Color development of an imagewise exposed photographic silver halide element is carried out by contacting the element with a color developing composition of this invention under suitable time and temperature conditions, in suitable processing equipment, to produce the desired developed color image. Additional processing steps can then be carried out using conventional procedures, including but not limited to, one or more color development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C-41 processing of color negative films, Process RA-4 for processing color papers and Process E-6 for processing color reversal films (see for example, *Research Disclosure* publication 38957 noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

More details of the element structure and components, and suitable methods of processing various types of elements are described in *Research Disclosure* publication 38957 noted above. Included within such teachings in the art is the use of various classes of cyan, yellow and magenta color couplers that can be used with the present invention (including pyrazolone and pyrazolotriazole type magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

The color developing composition of this invention can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. These processors are sometimes included in what are known as "minilabs." Such processing methods and equipment are described, for example, in U.S. Pat. No. 5,436,118 (Carli et al.) and publications noted therein. Some minilab processing machines are commercially available as Noritsu 2211SM Printer/Paper Processor, Noritsu 2102SM Printer/Paper Processor, and Noritsu 2301SM Printer/Paper Processor.

Color development is generally followed by desilvering using-separate bleaching and fixing steps, or a combined bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure* publication 38957 noted above, U.S. Pat. No. 5,582,958 (Buchanan et al.) and U.S. Pat. No. 5,753,423 (Buongiorne et al.). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003 (Ueda et al.), and ethylenediamine monosuccinic acid and similar compounds as described in U.S. Pat. No. 5,691,120 (Wilson et al.). Useful fixing agents are also well known in the art and include various thiosulfates and thiocyanates or mixtures thereof as described for example in U.S. Pat. No. 6,013,424 (Schmittou et al.).

Rinsing and/or stabilizing steps can be carried out after desilvering if desired using various rinsing or stabilizing compositions that may include one or more anionic or nonionic surfactants. Representative compositions for this purpose are, for example, described in U.S. Pat. No. 5,534,396 (McGuckin et al.), U.S. Pat. No. 5,578,432 (McGuckin et al.), U.S. Pat. No. 5,645,980 (McGuckin et al.), U.S. Pat. No. 5,667,948 (McGuckin et al.), and U.S. Pat. No. 5,716,765 (McGuckin et al.).

The processing time and temperature used for each processing step of the present invention are generally those conventionally used in the art. For example, color development is generally carried out at a temperature of from about 20 to about 60° C. The overall color development time can be up to 40 minutes, and preferably from about 75 to about 450 seconds. The shorter overall color development times are desired for processing color photographic papers. Conventional conditions can be used for other processing steps including desilvering and rinsing/stabilizing.

The color developing composition of this invention can be used as a working strength solution, or as a replenisher. Alternatively, the concentrated compositions of this invention can be diluted at least two times (that is, one volume composition to one volume water or buffer), and preferably at least four times, and up to 8 times, to provide a working strength solution or replenisher.

The following examples are provided to illustrate the practice of this invention and not to limit it in any way. Unless otherwise indicated, percentages are by weight.

EXAMPLE 1

Color Developing Composition and Aeration Studies

A working strength color developing composition of this invention was prepared by adding L-cysteine hydrochloride to a color developing composition having the components and amounts (along with the Control compositions) shown in TABLE VIII below. The Control A composition is a large tank color developing composition containing hydroxylamine sulfate but no L-cysteine hydrochloride. The Control B composition is similar but hydroxylamine derivative was omitted. All compositions were prepared and monitored as replicates under accelerated oxidation at 325 ml/min at room temperature in an open glass container. A decrease in volume due to evaporation was compensated for by periodically adding deionized water. The composition was analyzed periodically for the amount of remaining color developing agent and the change in pH. The results of these measurements are shown in the following TABLE IX. Composition stability or instability is evident by the loss in KODAK Color Developing Agent CD-4 (or loss in color developing agent activity).

TABLE VIII

| | AMOUNT | | |
|---|---|---|---|
| COMPONENT | CONTROL A | CONTROL B | EXAMPLE 1 |
| Sodium bromide | 1.3 g | 1.3 g | 1.3 g |
| Diethylenetriaminepentaacetic acid, pentasodium salt | 8.46 g | 8.46 g | 8.46 g |
| Potassium iodide | 0.0012 g | 0.0012 g | 0.0012 g |
| Sodium metabisulfite | 3.24 g | 3.24 g | 3.25 g |
| L-Cysteine | 0 | 0 | 12.1 g |
| Hydroxylamine sulfate | 2 g | 0 | 0 |
| Potassium bicarbonate | 2.25 g | 2.25 g | 2.25 g |
| KODAK Color Developing Agent CD-4 | 4.45 g (0.0152 mol/l) | 4.45 g (0.0152 mol/l) | 4.45 g (0.0152 mol/l) |
| Potassium carbonate (47%) | 69.48 g | 69.48 g | 69.48 g |
| Water | To make 1 liter | To make 1 liter | To make 1 liter |

The pH of each composition in TABLE VIII was adjusted to 10.10 using sulfuric acid or potassium hydroxide.

TABLE IX

| | KODAK Color Developing Agent CD-4 Remaining (%) | | |
|---|---|---|---|
| Time (hours) | Control A | Control B | Example 1 |
| 0 | 100 | 100 | 100 |
| 24 | 58.9 | 47.8 | 93.5 |
| 48 | 22.2 | 0 | 87.0 |
| 72 | 0 | 0 | 58.7 |

These results show that the color developing composition of this invention containing L-cysteine is more stable than the standard composition (Control A) containing hydroxylamine sulfate as well as the composition from which this conventional antioxidant has been omitted (Control B). The Example 1 composition exhibited only a small increase in pH during the keeping time.

EXAMPLE 2

Three-part Color Developing Kit With Preservative in Part A

A three-part color developing kit of this invention was formulated with the following components in the three separate parts:

| PART | COMPONENT | CONCENTRATION (g/l) Comparison | Invention |
|---|---|---|---|
| A (pH 10.5) | Triethanolamine (85%) | 134.81 | 134.81 |
| | N,N-Diethylhydroxylamine (85%) (optional) | 115.96 | 115.96 |
| | Phorwite REU optical brightener (180) | 23.84 | 23.84 |
| | Versa-TL 74 (30%) sulfonated polystyrene | 3.7 | 3.7 |
| | L-Cysteine | 0 | 129 (1.065 mol/l) |
| B (pH 1.2) | Kodak Color Developing Agent CD-3 | 295.65 | 295.65 |
| | Lithium sulfate | 86.96 | 86.96 |
| | Magnesium sulfate.$7H_2O$ | 9.0 | 9.0 |
| | Potassium sulfite (45%) | 36.3 | 36.3 |
| C (pH 13.0) | Potassium hydroxide (50%) | 63.02 | 63.02 |
| | Potassium chloride | 59.97 | 59.97 |
| | Potassium bromide | 0.375 | 0.375 |
| | DEQUEST ™ 2010 sequestering agent (60%) | 12.89 | 12.89 |
| | Potassium carbonate (47%) | 789.1 | 789.1 |

Each of solution A, B, and C was diluted to 1 liter with water. Lithium and magnesium sulfates can be removed if DEQUEST™ 2066 sequestering agent is used instead of DEQUEST™ 2010 sequestering agent in Part C. Approximately 46.5 ml of Part A, 23.0 ml of Part B, and 66.7 ml of Part C were combined and diluted to make 1 liter of a working strength color developing solution of this invention having a pH of 10.17.

EXAMPLE 3

Three-part Color Developing Kit With Preservative in Part B

In this embodiment of the invention, the sulfur compound preservative was placed in the Part B solution. The three parts had the following components:

| PART | COMPONENT | CONCENTRATION (g/l) Comparison | Invention |
|---|---|---|---|
| A (pH 10.5) | Triethanolamine (85%) | 134.81 | 134.81 |
| | N,N-Diethylhydroxylamine (85%) (optional) | 115.96 | 115.96 |
| | Phorwite REU (180) optical brightener | 23.84 | 23.84 |
| | Versa-TL 74 (30%) sulfonated polystyrene | 3.7 | 3.7 |
| B (pH 1.9) | Kodak Color Developing Agent CD-3 | 295.65 | 295.65 |
| | L-Cysteine | 0 | 260.8 |

-continued

| PART | COMPONENT | CONCENTRATION (g/l) Comparison | Invention |
|---|---|---|---|
| C (pH 13.0) | Potassium hydroxide (50%) | 63.02 | 63.02 |
| | Potassium chloride | 59.97 | 59.97 |
| | Potassium bromide | 0.375 | 0.375 |
| | DEQUEST ™ 2066 sequestering agent (25%) | 40 | 40 |
| | Potassium carbonate (47%) | 0 | 150 |
| | Potassium carbonate (47%) | 789.1 | 789.1 |

Approximately 46.5 ml of Part A, 23.0 ml of Part B, and 66.7 ml of Part C were combined and diluted to make 1 liter of a working strength color developing solution of this invention having a pH of 10.2.

EXAMPLE 4

Three-part Color Developing Kit With Preservative in Part C

In this embodiment of the invention, the sulfur compound preservative was placed in the Part C solution. The three parts had the following components:

| PART | COMPONENT | CONCENTRATION (g/l) Comparison | Invention |
|---|---|---|---|
| A (pH 10.5) | Triethanolamine (85%) | 134.81 | 134.81 |
| | N,N-Diethylhydroxylamine (85%) (optional) | 115.96 | 115.96 |
| | Phorwite REU (180) optical brightener | 23.84 | 23.84 |
| | Versa-TL 74 (30%) sulfonated polystyrene | 3.7 | 3.7 |
| B (pH 1.9) | Kodak Color Developing Agent CD-3 | 295.65 | 295.65 |
| | Magnesium sulfate.$7H_2O$ | 9.0 | 9.0 |
| | Potassium sulfite (45%) | 36.3 | 36.3 |
| | Lithium sulfate | 86.96 | 86.96 |
| C (pH 13.0) | Potassium hydroxide (49%) | 63.02 | 63.02 |
| | Potassium chloride | 59.97 | 59.97 |
| | Potassium bromide | 0.375 | 0.375 |
| | DEQUEST ™ 2010 sequestering agent (25%) | 12.89 | 12.89 |
| | L-Cysteine | 0 | 90 |
| | Potassium carbonate (47%) | 789.1 | 789.1 |

Lithium and magnesium sulfates in Part B are optional. Approximately 46.5 ml of Part A, 23.0 ml of Part B, and 66.7 ml of Part C were combined and diluted to make 1 liter of a working strength color developing solution of this invention having a pH of 10.2.

EXAMPLE 5

Color Pater Processing

Samples of KODAK Edge 8 Color Paper were given a step wedge test object exposure at 1/10 sec with HA-50, NP-11 filters, and 0.3 Inconel on a conventional 1B sensitometer. The samples were then processed using a color developing composition provided by combining the three solutions of the three-part kit of Example 2. Processing was carried out in a deep tank processor using conventional EKTACOLOR Process RA-4 conditions and steps as follows:

| | | |
|---|---|---|
| Color Development | 38° C. | 45 seconds |
| Bleach/fixing | 35° C. | 45 seconds |
| Washing/Stabilizing | 35° C. | 90 seconds |

Bleach/fixing was carried out using commercially available KODAK EKTACOLOR Prime Bleach-Fix and the washing step was carried out using KODAK EKTACOLOR Prime Stabilizer. After processing, the color paper samples were allowed to dry in the air at ambient temperature. The desired colored images were obtained in all of the samples.

EXAMPLE 6

Two-part Color Developing Kit

A two-part color developing kit of the present invention was prepared with two following solutions:

| PART | COMPONENTS | CONCENTRATION (g/l) |
|---|---|---|
| A (pH 14) | Potassium hydroxide (50%) | 40 |
| | Triethanolamine (85%) | 58.4 |
| | DEQUEST ™ 2066 (25%) sequestering agent | 41.6 |
| | Versa-TL 74 (30%) sulfonated polystyrene | 1.36 |
| | Potassium chloride | 32 |
| | Potassium bromide | 0.24 |
| | L-Cysteine | 48.4 |
| | Potassium carbonate | 420.8 |
| B (pH 5.7) | Potassium sulfite (45%) | 6.72 |
| | N,N-Diethylhydroxylamine (85%) (optional) | 43.2 |
| | KODAK Color Developing Agent CD-3 | 54.4 |
| | Phorwite REU (180) optical brightener | 8.8 |

In this example approximately 125 ml of Part A and 125 ml Part B were combined and diluted to make 1 liter of working strength developing composition. The final composition pH was 10.76.

The resulting color developing composition was used for color development of imagewise exposed samples of commercially available Kodak Ektacolor Edge 8 Color Paper samples in a deep-tank conventional RA-4 process as described in Example 5. The desired color images were obtained.

EXAMPLE 7

Alternative Two-part Color Developing Kit

Another two-part kit of this invention was prepared similar to that described in Example 6 except that L-cysteine (48.4 g/l) was placed in Part B. The two solutions were then similarly combined, diluted, and used to obtain color images in samples of Kodak Ektacolor Edge VIII Color Paper.

EXAMPLES 8–9

Color Developing Compositions

Conventional KODAK EKTACOLOR™ Prime RA Color Developer and Replenisher (Control C) was compared to a similar composition with reduced N,N-diethylhydroxylamine and two compositions of this invention. The components of the compositions are shown in the following TABLE X. The compositions were aerated at room temperature, and monitored periodically for the amount of remaining color developing agent, hydroxylamine derivative and changes in pH. Composition stability or instability is evident by the loss in color developing agent (or loss in color developing agent activity) and loss in hydroxyl amine derivative (or loss in antioxidant activity). The results of these measurements are shown in the following TABLES XI and XII.

TABLE X

| | Amount | | | |
|---|---|---|---|---|
| Component | Control C | Control D | Example 8 | Example 9 |
| Versa TL(sulfonated polystyrene) | 0.17 g | 0.17 g | 0.17 g | 0.17 g |
| Potassium sulfite (45%) | 0.84 g | 0.84 g | 0.84 g | 0.84 g |
| Triethanolamine (85%) | 7.3 g | 7.3 g | 7.3 g | 7.3 g |
| N,N-diethylhydroxylamine | 5.4 g (0.06 mol/l) | 0.68 g (0.0075 mol/l) | 0 | 0.68 g (0.0075 mol/l) |
| L-Cysteine hydrochloride | 0 | 0 | 15.67 g (0.1 mol/l) | 15.67 g (0.1 mol/l) |
| Phorwite REU optical brightener | 1.1 g | 1.1 g | 1.1 g | 1.1 g |
| Lithium sulfate | 2.0 g | 2.0 g | 2.0 g | 2.0 g |
| DEQUEST ™ 2010 sequestering agent | 0.86 g | 0.86 g | 0.86 g | 0.86 g |
| Potassium chloride | 4 g | 4 g | 4 g | 4 g |
| Potassium bromide | 0.03 g | 0.03 g | 0.03 g | 0.03 g |
| Kodak Color Developing Agent CD-3 | 6.8 g (0.016 mol/l) | 6.8 g (0.016 mol/l) | 6.8 g (0.016 mol/l) | 6.8 g (0.016 mol/l) |
| Potassium hydroxide (50%) | 5 g | 5 g | 5 g | 5 g |
| Potassium carbonate (47%) | 52.6 g (0.18 mol/l) | 52.6 g (0.18 mol/l) | 52.6 g (0.18 mol/l) | 52.6 g (0.18 mol/l) |
| Water | To make 1 liter | To make 1 liter | To make 1 liter | To make 1 liter |

The pH of each composition in TABLE X was adjusted to 10.1 using sulfuric acid or potassium hydroxide.

TABLE XI

| | Kodak Color Developing Agent CD-3 Remaining (%) | | | |
|---|---|---|---|---|
| Time (hours) | Control C | Control D | Example 8 | Example 9 |
| 0 | 100 | 100 | 100 | 100 |
| 24 | 96.0 | 60.1 | 100 | 100 |
| 48 | 77.9 | 8.5 | 95.2 | 98.3 |
| 72 | 13.5 | 2.7 | 68.9 | 79.7 |

TABLE XII

| | N,N-Diethylhydroxylamine Remaining (%) | | |
|---|---|---|---|
| Time (hours) | Control C | Control D | Example 9 |
| 0 | 100 | 100 | 100 |
| 24 | 52.5 | 0 | 87.5 |
| 48 | 1.6 | 0 | 75.0 |
| 72 | 0 | 0 | 37.5 |

These examples show that the Control D with ⅛ the conventional amount of N,N-diethylhydroxylamine antioxidant is less stable than the standard KODAK EKTACOLOR RA Prime Color Developer (Control C). The presence of 0.1 mol/l of L-cysteine provided increased stability, and a combination of L-cysteine and the conventional antioxidant N,N-diethylhydroxylamine respectively appears to synergistically improve the stability of color developing composition. Additionally, Table XII shows that L-cysteine also improved the stability of the hydroxylamine derivative in the color developing composition. A small increase in pH was observed with the compositions containing L-cysteine.

EXAMPLE 10

Stabilized Single-part Color Developing Compositions

A single-part concentrated color developing composition of this invention was prepared using the components shown in the following TABLE XIII and compared to a standard EKTACOLOR Prime SP Color Paper Developer. The compositions were monitored under accelerated oxidation and monitored for remaining color developing agent and changes in pH as described in Example 1. The results are shown in the following TABLE XIV.

TABLE XIII

| COMPONENT | CONTROL E | EXAMPLE 10 |
|---|---|---|
| Water | 12.53 g | 12.53 g |
| Triethanolamine (85%) | 2.99 g | 2.99 g |
| Sodium hydroxide (50%) | 3.99 g | 3.99 g |
| N,N-diethylhydroxylamine antioxidant | 4.05 g | 4.05 g |
| L-Cysteine hydrochloride | 0 | 35.12 g |
| Phorwite REU optical brightener | 1.1 g | 1.1 g |
| DEQUEST ™ 2066 sequestering agent | 5.2 g | 5.2 g |
| DEQUEST ™ 2010 sequestering agent | 0.55 g | 0.55 g |
| Diethylene glycol | 79.3 g | 79.3 g |
| Potassium bromide | 0.025 g | 0.025 g |
| KODAK Color Developing Agent CD-3 | 6.8 g (0.016 mol/l) | 6.8 g (0.016 mol/l) |
| Potassium carbonate (47%) | 45.93 g | 45.93 g |
| Potassium bicarbonate | 1.9 g | 1.9 g |
| Water | To make 1 liter | To make 1 liter |

The pH was adjusted to 10.48 with sulfuric acid or potassium hydroxide.

TABLE XIV

| | KODAK Color Developing Agent CD3 Remaining (%) | |
|---|---|---|
| Time (weeks) | Control E | Example 10 |
| 0 | 100 | 100 |
| 2 | 93.4 | 100 |
| 4 | 38.3 | 96.6 |
| 6 | 8.4 | 74.7 |

These results show that in the concentrated single-part environment containing diethylene glycol and a phosphonic acid sequestering agent, the L-cysteine hydrochloride also improved the stability of the color developing composition with little change in pH.

EXAMPLES 11–13

Effect of Additional Sulfur Compound Preservatives

We compared the effects of three additional preservatives in concentrated single-part compositions of this invention. The compositions, shown in the following TABLE XV were aerated at room temperature and monitored periodically for the amount of remaining color developing agent, N-N-diethylhydroxylamine antioxidant, and changes in pH. The results of these measurements are show in the following TABLES XVI and XVII.

TABLE XV

| | Amount | | | |
|---|---|---|---|---|
| Component | Control F | Example 11 | Example 12 | Example 13 |
| Water | 12.53 g | 12.53 g | 12.53 g | 12.53 g |
| Sodium Hydroxide (50%) | 3.99 g | 3.99 g | 3.99 g | 3.99 g |
| N,N-diethyl-hydroxylamine | 0.51 g | 0.51 g | 0.51 g | 0.51 g |
| L-Methionine | 0 | 14.21 g (0.1 mol/1) | 0 | 0 |
| L-Cystine | 0 | 0 | 24.03 g (0.1 mol/1) | 0 |
| L-Cysteine hydrochloride | 0 | 0 | 0 | 15.67 g (0.1 mol/l) |
| Diethylene glycol | 79.3 g | 79.3 g | 79.3 g | 79.3 g |
| DEQUEST ™ 2010 sequestering agent | 0.55 g | 0.55 g | 0.55 g | 0.55 g |
| Potassium Carbonate (47%) | 45.93 g | 45.93 g | 45.93 g | 45.93 g |
| Potassium Bicarbonate | 1.9 g | 1.9 g | 1.9 g | 1.9 g |
| Potassium bromide | 0.025 g | 0.025 g | 0.025 g | 0.025 g |
| Blankophor REU optical brightener | 1.1 g | 1.1 g | 1.1 g | 1.1 g |
| Triethanolamine (85%) | 2.99 g | 2.99 g | 2.99 g | 2.99 g |
| DEQUEST ™ 2066 sequestering agent | 5.2 g | 5.2 g | 5.2 g | 5.2 g |
| Water to make | 1 liter | 1 liter | 1 liter | 1 liter |

The pH of each composition was adjusted to 10.48 using with $H_2SO_4$ or KOH.

TABLE XVI

| | KODAK Color Developer CD-3 Remaining (%) | | | |
|---|---|---|---|---|
| Time (hours) | Control F | Example 11 | Example 12 | Example 13 |
| 0 | 100 | 100 | 100 | 100 |
| 24 | 58.1 | 71.2 | 78.0 | 100 |
| 48 | 12.4 | 35.7 | 53.9 | 94.1 |
| 72 | 0 | 10.9 | 38.3 | 54.2 |

TABLE XVII

| | N,N-Diethylhydroxylamine Remaining (%) | | | |
|---|---|---|---|---|
| Time (hours) | Control F | Example 11 | Example 12 | Example 13 |
| 0 | 100 | 100 | 100 | 100 |
| 48 | 92.4 | 97.3 | 98.5 | 93.7 |
| 72 | 67.3 | 89.3 | 96.1 | 77.3 |
| 96 | 21.3 | 56.7 | 92.4 | 45.3 |

These results show that the three sulfur compound preservatives provided a synergistic improvement in composition stability in the presence of the conventional hydroxylamine derivative. Additionally, improved stability of the hydroxylamine and pH were also observed.

EXAMPLE 14

Single-part Concentrate Without Hydroxylamine Derivative

A first solution was prepared with the following components:

| | |
|---|---|
| Water (demineralized) | 46.1 g |
| 50% Sodium hydroxide solution | 30.7 g |
| L-Cysteine hydrochloride (15.67 g pre-diluted in 15 g of water and 15 g of diethylene glycol) | 45.67 g |
| KODAK Color Developer CD-3 | 52.3 g |
| Diethylene glycol | 385 g |
| Diethylene glycol (wash) | 96 g |

This solution was brought up to a pH of 12.5 with potassium hydroxide (47%) and then filtered. The following second solution was prepared with the following components and the first solution was then added to it. The resulting solution was filtered. The resulting composition exhibited desired stability from the presence of L-cysteine hydrochloride.

| | |
|---|---|
| Water (demineralized) | 50.3 g |
| DEQUEST ™ 2010 sequestering agent | 0.55 g |
| 47% Potassium carbonate solution | 353.3 g |
| Potassium bicarbonate | 14.6 g |
| Potassium bromide | 0.28 g |
| Blankophor REU 180 optical brightener | 8.5 g |
| 85% Triethanolamine solution | 23 g |
| DEQUEST ™ 2066 sequestering agent | 40 g |
| Diethylene glycol | 129 g |

EXAMPLE 15

Color Paper Processing

Samples of KODAK Edge 8 Color Paper were given a step wedge test object exposure at 1/10 sec with HA-50, NP-11 filters, and 0.3 Inconel on a conventional 1B sensitometer. The samples were then processed using a color developing composition provided by diluting 130 ml of the composition of Example 14 to 1 liter (pH 10.86). Processing was carried out in a deep tank processor using conventional EKTACOLOR™ Process RA-4 conditions and steps as follows:

| | | |
|---|---|---|
| Color Development | 38° C. | 45 seconds |
| Bleach/fixing | 35° C. | 45 seconds |
| Washing/Stabilizing | 35° C. | 90 seconds |

Bleach/fixing was carried out using commercially available KODAK EKTACOLOR Prime Bleach-Fix and the washing step was carried out using KODAK EKTACOLOR Prime Stabilizer. After processing, the color paper-samples were allowed to dry in the air at ambient temperature. The desired colored images were obtained in all of the samples.

EXAMPLE 16

Three-part Color Developing Kit for Color Negative Film Processing With Preservative in Part A A three-part color developing kit of this invention was formulated with the following components in the three separate parts (or solutions):

| | | CONCENTRATION (g/l) | |
|---|---|---|---|
| PART | COMPONENT | Working Strength | Concen-trated |
| A | Water | 19.06 | |
| (pH 10.9) | Sodium bromide | 1.3 | 2.6 |
| | Diethylenetriaminepentaacetic acid, pentasodium salt (40%) | 8.46 | 16.92 |
| | Potassium iodide | 0.0012 | 0.0024 |
| | Sodium metabisulfite | 3.08 | 6.16 |
| | Potassium carbonate (47%) | 69.48 | 138.96 |
| | Potassium bicarbonate | 2.25 | 4.5 |
| | L-Cysteine (0.05 mol/l) | 6.1 | 12.1 |
| B | Water | 5.6 | |
| (pH 3.1) | Hydroxylamine sulfate | 2 | 0 |
| | Potassium sulfite (45%) | 36.3 | 36.3 |
| C | Water | 12.57 | |
| (pH 2.1) | Sodium metabisulfite | 0.048 | 0 |
| | KODAK Color Developing Agent CD-4 | 4.45 | 8.9 |
| | Sodium metabisulfite | 0.111 | 0 |

The sulfur compound preservative was readily dissolved in the concentrated Part A with a slight purple tint that turned clear with base. Each of solutions A, B, and C was diluted to 1 liter with water. Approximately, 333.3 ml of Part A, 333.3 ml of Part B, and 333.3 ml of Part C were combined to make 1 liter of a working strength which was used as a color developing composition for processing samples of Kodak GOLD™ Color Negative Film.

EXAMPLE 17

Three-part Color Developing Kit for Color Negative Film Processing With Preservative in Part B A three-part color developing kit of this invention was formulated with the following components in the three separate parts (or solutions):

| | | CONCENTRATION (g/l) | |
|---|---|---|---|
| PART | COMPONENT | Working Strength | Concen-trated |
| A | Water | 19.06 | |
| (pH 10.9) | Sodium bromide | 1.3 | 2.6 |
| | Diethylenetriaminepentaacetic acid, pentasodium salt (40%) | 8.46 | 16.92 |
| | Potassium iodide | 0.0012 | 0.0024 |
| | Sodium metabisulfite | 3.08 | 6.16 |
| | Potassium carbonate (47%) | 69.48 | 138.96 |
| | Potassium bicarbonate | 2.25 | 4.5 |
| B | Water | 5.6 | |
| (pH 3.1) | Hydroxylamine sulfate (optional) | 2 | 0 |
| | L-Cysteine (0.05 mol/l) | | 12.1 |
| | Potassium sulfite (45%) | 36.3 | 36.3 |
| C | Water | 12.57 | |
| (pH 2.1) | Sodium metabisulfite | 0.048 | 0 |
| | KODAK Color Developing Agent CD-4 | 4.45 | 8.9 |
| | Sodium metabisulfite | 0.111 | 0 |

The sulfur compound preservative was readily dissolved in the concentrated Part B with or without hydroxylamine sulfate. The solutions A, B, and C were each diluted to 1 Liter with water, and then approximately 333.3 ml of Part A, 333.3 ml of Part B, and 333.3 ml of Part C were combined to make 1 liter of a working strength color developing solution.

EXAMPLE 18

Three-part Color Developing Kit for Color Negative Film Processing With Preservative in Part C A three-part color developing kit of this invention was formulated with the following components in the three separate parts (or solutions):

| PART | COMPONENT | CONCENTRATION (g/l) Working Strength | Concentrated |
|---|---|---|---|
| A | Water | 19.06 | |
| (pH 10.9) | Sodium bromide | 1.3 | 2.6 |
| | Diethylenetriaminepentaacetic acid, pentasodium salt (40%) | 8.46 | 16.92 |
| | Potassium iodide | 0.0012 | 0.0024 |
| | Sodium metabisulfite | 3.08 | 6.16 |
| | Potassium carbonate (47%) | 69.48 | 138.96 |
| | Potassium bicarbonate | 2.25 | 4.5 |
| B | Water | 5.6 | |
| (pH 3.1) | Hydroxylamine sulfate | 2 | 0 |
| | Potassium sulfite (45%) | 36.3 | 36.3 |
| C | Water | 12.57 | |
| (pH 2.1) | Sodium metabisulfite | 0.048 | 0 |
| | KODAK Color Developing Agent CD-4 | 4.45 | 8.9 |
| | Sodium metabisulfite | 0.111 | 0 |
| | L-Cysteine (0.05 mol/l) optional | 6.1 | 12.1 |

Each of solutions A, B, and C was diluted to 1 liter with water. Approximately 333.3 ml of Part A, 333.3 ml of Part B, and 333.3 ml of Part C were combined to make 1 liter of a working strength color developing solution.

An alternative three-part kit with the sulfur preservative in all of the Parts A, B and C, was also formulated (for example, in equal concentrations in all three parts). Additionally, other sequestering agents including DEQUEST™ 2066 or DEQUEST™ 2010 could be used in these formulations.

EXAMPLE 19

Two-part Color Developing Kit for Color Negative Film Processing With Preservative in Part A In this example of the invention a two-part color developing kit was formulated with the following components in two separate parts (or solutions):

| PART | COMPONENT | CONCENTRATION (g/l) Working Strength | Concentrated |
|---|---|---|---|
| A | Water | 19.06 | |
| (pH 10.9) | Sodium bromide | 1.3 | 2.6 |
| | Diethylenetriaminepentaacetic acid, pentasodium salt (40%) | 8.46 | 16.92 |
| | Potassium iodide | 0.0012 | 0.0024 |
| | Sodium metabisulfite | 3.08 | 6.16 |
| | Potassium carbonate (47%) | 69.48 | 138.96 |
| | Potassium bicarbonate | 2.25 | 4.5 |
| | L-Cysteine (0.05 mol/l) optional | 6.1 | 12.1 |

-continued

| PART | COMPONENT | CONCENTRATION (g/l) Working Strength | Concentrated |
|---|---|---|---|
| B | Water | 5.6 | |
| (pH 3.1) | Hydroxylamine sulfate | 2 | 0 |
| | KODAK Color Developing Agent CD-4 | 4.45 | 8.9 |
| | L-Cysteine (0.05 mol/l) optional | | 12.1 |

Each of solutions A and B was diluted to 1 liter with water. Approximately 500 ml of Part A and 500 ml of Part B were combined to make 1 liter of a working strength color developing solution.

EXAMPLE 20

Two-part Color Developing Kit for Color Negative Film Processing With Preservative in Part B In this example of the invention, the two-part color developing kit of Example 19 was changed to put the sulfur preservative in the Part B solution with or without hydroxylamine sulfate. This color developing kit was also used to provide color images with Kodak GOLD™ 100 Color Negative Film.

The invention has been described in detail with particular reference to preferred embodiments thereof, but it will be understood that variations and modifications can be effected within the spirit and scope of the invention.

We claim:

1. An aqueous photographic color developing composition having a pH of from about 7 to about 13 and comprising:

a) at least 0.0005 mol/l of a color developing agent, and b) as a preservative for said color developing agent, from about 0.0005 to about 0.5 mol/l of a sulfur compound that is represented by one of the following Structures I, II, III, and IV:

$$M_1S—R—CH(NH_2)—COOM_2 \quad (I)$$

$$M_1S—R_1—COOM_2 \quad (II)$$

$$R_2—S—S—R_2 \quad (III)$$

$$R_3HN—R_4—SM_1 \quad (IV)$$

wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a —$CH(NHR_3)$—$COOM_2$ or —($C_1$–$C_3$)alkylene-$CH(NHR_3)$—$COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group.

2. The color developing composition of claim 1 having a pH of from about 8 to about 12, said color developing agent is present in an amount of from about 0.05 to about 0.8 mol/l, and said preservative is present in an amount of from about 0.05 to about 3 mol/l.

3. The color developing composition of claim 1 being substantially free of hydroxylamine and hydroxylamine derivatives.

4. The color developing composition of claim 1 further comprising a water-miscible or water-soluble hydroxy-substituted, straight-chain organic solvent that has a molecular weight of from about 50 to about 200.

5. The color developing composition of claim 4 further comprising a buffering agent that is soluble in said organic solvent.

6. The color developing composition of claim 1 further comprising at least one polyphosphonic acids or salts thereof as a calcium ion sequestering agent, one of which is a polyaminopolyphosphonic acid or salt thereof that is present in an amount of from about 0.005 to about 0.3 mol/l or a diphosphonic acid or salt thereof that is present in an amount of up to 0.3 mol/l.

7. An The color developing composition of claim 1 wherein R is an alkylene group having 1 to 4 carbon atoms, $R_1$ is an unsubstituted alkylene group having 1 or 2 carbon atoms, $R_3$ is an alkyl group having 1 to 4 carbon atoms, $R_4$ is an alkylene group having 1 to 4 carbon atoms, $M_1$ is hydrogen and $M_2$ is hydrogen or an alkali metal ion.

8. The color developing composition of claim 1 wherein said preservative is one or more isomers of cysteine or a hydrochloride salt thereof, homocysteine, methionine, 3-mercaptovaline, 2-mercaptopropionic acid, 3-mercaptopropionic acid, 3-mercapto-1-benzoic acid, mercaptoacetic acid, one or more isomers of cystine or hydrochloride salts thereof, mesocystine, 3,3'dithiobisvaline or a hydrochloride salt thereof, 2-aminoethanethiol, 2-aminoethanethiol hydrochloride, 3-aminopropanethiol hydrochloride, or any appropriate carboxylate salts thereof.

9. The color developing composition of claim 8 wherein said sulfur-containing compound is one or more isomers or salts of cysteine or cystine.

10. A concentrated, aqueous, single-part color developing composition having a pH of from about 8 to about 12 and comprising:

a) from about 0.005 to about 1 mol/l of a color developing agent in free base form, b) less than 0.00005 mol/l of hydroxylamine or a derivative thereof, c) a water-miscible or water-soluble hydroxy-substituted, straight-chain organic solvent that has a molecular weight of from about 50 to about 200, d) a buffering agent that is solvent in said organic solvent, e) from about 0.005 to about 0.3 mol/l of a calcium ion sequestering agent, and f) as a preservative for said color developing agent, from about 0.005 to about 5 mol/l of one or more isomers of cysteine or a hydrochloride salt thereof, homocysteine, methionine, 3-mercaptovaline, 2-mercaptopropionic acid, 3-mercaptopropionic acid, 3-mercapto-1-benzoic acid, mercaptoacetic acid, one or more isomers of cystine or hydrochloride -salts thereof, mesocystine, 3,3'-dithiobisvaline or a hydrochloride salt thereof, 2-aminoethanethiol, 2-aminoethanethiol hydrochloride, 3-aminopropanethiol hydrochloride, or any appropriate carboxylate salt thereof.

11. The color developing composition of claim 10 comprising cysteine or a hydrochloride salt thereof as said preservative.

12. A two-part color developing kit comprising:

(I) a first aqueous solution having a pH of from about 9 to about 14, and (II) a second aqueous solution having a pH of from about 3 to about 7 and comprising:

(a) at least 0.005 mol/l of a color developing agent, (b) at least 0.001 mol/l of sulfite ions, further comprising, in said first or second aqueous solution, from about 0.005 to about 5 mol/l of a sulfur compound represented by one of the following Structures I, II, III, and IV:

$$M_1S—R—CH(NH_2)—COOM_2 \quad \text{I}$$

$$M_1S—R_1—COOM_2 \quad \text{II}$$

$$R_2—S—S—R_2 \quad \text{III}$$

$$R_3HN—R_4—SM_1 \quad \text{IV}$$

wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group.

13. The color developing kit of claim 12 wherein said sulfur compound is present only in said first aqueous solution.

14. A method of making a working strength color developing composition from the color developing kit of claim 12 comprising:

(A) combining said first and second aqueous solutions in such a manner that the volume ratio of said first aqueous solution to said second aqueous solution is from about 2:1 to about 1:2, and, B) simultaneously or subsequently, diluting said first and second aqueous solutions with water in such a manner as to dilute said first aqueous solution at least two times and said second aqueous solution at least two times.

15. A three-part color developing kit comprising:

(I) a first aqueous solution having a pH of from about 9 to about 13, (II) a second aqueous solution having a pH of from about 1 to about 4 and comprising:

(a) at least 0.005 mol/l of a color developing agent, and (b) at least 0.001 mol/l of sulfite ions, and (III) a third aqueous solution having a pH of from about 10 to about 13.5, further comprising, in said first, second, or third aqueous solution, from about 0.005 to about 5 mol/l of a sulfur compound represented by one of the following Structures I, II, III, and IV:

$$M_1S—R—CH(NH_2)—COOM_2 \quad \text{I}$$

$$M_1S—R_1—COOM_2 \quad \text{II}$$

$$R_2—S—S—R_2 \quad \text{III}$$

$$R_3HN—R_4—SM_1 \quad \text{IV}$$

wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group.

16. A method of making a working strength color developing composition from the three-part color developing kit of claim 15 comprising:

(A) combining said first, second, and third aqueous solutions noted above in such a manner that the volume ratio of said first aqueous solution to said second concentrated aqueous solution is from about 1:1 to about 1.5:1, the volume ratio of said first aqueous solution to said third aqueous solution is from about 1:1 to about 1.5:1, and the volume ratio of said second aqueous solution to said third aqueous solution is from about 1:1 to about 1.5:1, and, B) simultaneously or subsequently, diluting said first, second, and third aqueous solutions with water in such a manner as to dilute said first aqueous solution at least 8 times, said second aqueous solution at least 10 times, and said third aqueous solution at least 10 times.

17. A method for providing a color image in a color photographic silver halide element comprising contacting said element with an aqueous photographic color developing composition having a pH of from about 7 to about 13 and comprising:

a) at least 0.005 mol/l of a color developing agent, and b) as a preservative for said color developing agent, from about 0.005 to about 5 mol/l of a sulfur compound that is represented by one of the following Structures I, II, III, and IV:

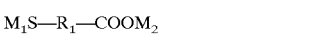

$$M_1S—R—CH(NH_2)—COOM_2 \quad (I)$$

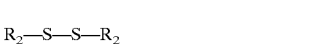

$$M_1S—R_1—COOM_2 \quad (II)$$

$$R_2—S—S—R_2 \quad (III)$$

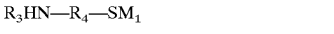

$$R_3HN—R_4—SM_1 \quad (IV)$$

wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group.

18. A method for providing a color image in a color photographic silver halide element comprising contacting said element with an aqueous working strength color developing composition prepared by diluting an aqueous color developing composition at least two times, said aqueous photographic color developing composition having a pH of from about 7 to about 13 and comprising:

a) at least 0.0005 mol/l of a color developing agent, and b) as a preservative for said color developing agent, from about 0.0005 to about 0.5 mol/l of a sulfur compound that is represented by one of the following Structures I, II, III, and IV:

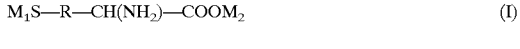

$$M_1S—R—CH(NH_2)—COOM_2 \quad (I)$$

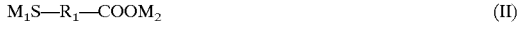

$$M_1S—R_1—COOM_2 \quad (II)$$

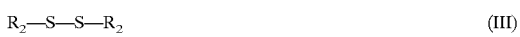

$$R_2—S—S—R_2 \quad (III)$$

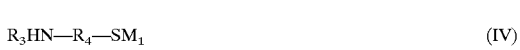

$$R_3HN—R_4—SM_1 \quad (IV)$$

wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group.

19. A method of photographic processing comprising the steps of:

A) color developing an imagewise exposed color photographic silver halide element with a photographic color developing composition comprising a color developing agent and a sulfur compound as a preservative for said color developing agent, said preservative being represented by one of the following Structures I, II, III, and IV:

$$M_1S—R—CH(NH_2)—COOM_2 \quad (I)$$

$$M_1S—R_1—COOM_2 \quad (II)$$

$$R_2—S—S—R_2 \quad (III)$$

$$R_3HN—R_4—SM_1 \quad (IV)$$

wherein R is a divalent aliphatic linking group having at least 1 carbon atom in the chain, $R_1$ is phenylene or an unsubstituted alkylene having 1 or 2 carbon atoms, $R_2$ is a monovalent aliphatic group having at least 2 carbon atoms and comprising a $—CH(NHR_3)—COOM_2$ or $—(C_1–C_3)$alkylene-$CH(NHR_3)—COOM_2$ group, $R_3$ is hydrogen, an alkyl group having 1 to 3 carbon atoms or phenyl, $R_4$ is an alkylene group, a cyclohexylene group, or a phenylene group, and $M_1$ and $M_2$ are independently hydrogen, an alkali metal or ammonium ion or methyl group, and B) desilvering said color developed color photographic silver halide element.

20. The method of claim 19 wherein said photographic color silver halide element is a color paper.

21. The method of claim 19 carried out in a minilab.

* * * * *